US006260844B1

(12) United States Patent
Naeser et al.

(10) Patent No.: US 6,260,844 B1
(45) Date of Patent: Jul. 17, 2001

(54) DEVICE FOR CONVEYING SHEETLIKE MATERIAL

(75) Inventors: Helmut Naeser; Gerhard Oberhoffner; Richard Pardubitzki, all of Munich (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/284,922

(22) PCT Filed: Oct. 21, 1997

(86) PCT No.: PCT/DE97/02444

§ 371 Date: Jun. 9, 1999

§ 102(e) Date: Jun. 9, 1999

(87) PCT Pub. No.: WO98/17567

PCT Pub. Date: Apr. 30, 1998

(30) Foreign Application Priority Data

Oct. 22, 1996 (DE) ..... 196 43 627

(51) Int. Cl.[7] ..... B65H 5/06
(52) U.S. Cl. ..... 271/272
(58) Field of Search ..... 271/272–274

(56) References Cited

U.S. PATENT DOCUMENTS 3,957,366 5/1976 Taylor et al. .
4,986,527 * 1/1991 Ogoda ..... 271/274
5,040,781 8/1991 Matoba .
5,147,274 9/1992 Mandel .
5,765,825 * 6/1998 Watase ..... 271/273

FOREIGN PATENT DOCUMENTS 39 30 737 A1 9/1989 (DE) .
0218344 * 9/1987 (JP) ..... 271/273
0249857 * 10/1990 (JP) ..... 271/273
403162344A * 7/1991 (JP) ..... 271/273
404116043A * 4/1992 (JP) ..... 271/272
405319617A * 12/1993 (JP) ..... 271/273

OTHER PUBLICATIONS

Patent Abstracts of Japan Application No. 02129035 dated May 21, 1990.

* cited by examiner

*Primary Examiner*—H. Grant Skaggs
(74) *Attorney, Agent, or Firm*—Schiff Hardin & Waite

(57) ABSTRACT

A device for conveying sheet-like material between a driven roller and a counter-pressure roller is disclosed. The device also includes opposing guide plates that form a channel for feeding the sheet-like material to the nip between the two rollers. At least one of the rollers includes a channel-like recess into which its associated guide plate extends.

9 Claims, 3 Drawing Sheets

DEVICE FOR CONVEYING SHEETLIKE MATERIAL

FIELD OF THE INVENTION

The invention is directed to a device for conveying sheet-shaped material.

BACKGROUND OF THE INVENTION

Such a device is utilized, for example, in a single-sheet printer in order to convey single sheets of paper from one processing station to a next processing station. More recent printers require a plurality of such conveyor devices, so that the demand for high operating dependability is made of these. It can occur in traditional conveyor devices that, given imprecise guidance of the leading edges, of the trailing edges and of the side edges of a single sheet, a corner of the single sheet can be bent over and the corner that has been bent over, what is referred to as a "dog ear", is fixed in the fashion of an ironing procedure due to the transport of the roller and counter-pressure roller lying opposite one another. Such a bent-over corner leads to a reject or can lead to a paper jam in the printer over the course of the further conveying path. It is therefore desirable to increase the operating dependability of such a conveyor device.

U.S. Pat. No. 5,040,781 discloses a device for conveying sheet material that is not flat, for example envelopes. The counter-pressure roller of this device has channel-shaped recessed in which the longitudinal edges of the envelope proceed. An obliquely guided envelope thus does not cause a conveying jam.

German AS 22 55 920 discloses a device for conveying card-shaped data carriers. The device has a driven roller that has a free-running counter-pressure roller residing opposite it. The data carriers are conveyed in the conveying nip between the two rollers.

DE-A 39 30 737 discloses a paper conveying means for printer devices, whereby paper is conveyed in the conveying nip between a driven roller and a counter-pressure roller that is likewise driven. The roller and the counter-pressure roller have recesses into which guide plates that supply the sheet-shaped material to the generated surfaces of the roller and the counter-pressure roller project.

Patent Abstracts of Japan, vol. 016, No. 195 (M-1246), May 12, 1992 and JP-A-04 028640 (Canon, Inc.), Jan. 31, 1992, disclose a paper guide unit wherein a counter-pressure roller has channel-shaped recesses into which tongues of a pressure plate engage. During operation, a single sheet is conveyed along the circumference of a conveyor roller in the conveying nip between conveyor roller and the pressure plate. The tongues engaging into the channel-shaped recesses of the counter-pressure roller guide the single sheet to the circumferential surface of the counter-pressure roller.

U.S. Pat. No. 3,957,366 discloses a paper delivery means wherein conveyor rollers residing opposite one another contain channel-shaped recesses.

Nose-shaped sections that are bent off at their ends and that have two operating positions project into these recesses. In the one operating position, the bent-off ends serve as detents that hold the single sheet at the front end edge, so that it arcs up given continued conveying. In the other operating position, the sections are lifted so that they release the single sheet and it is further-conveyed by the conveying nip formed by the rollers. The nose-shaped sections serve for aligning the single sheet, so that, after being supplied slanting, it can be further-conveyed with correctly aligned end edge.

U.S. Pat. No. 5,147,274 discloses an alignment means for sheet material. The sheet material is conveyed between rollers residing opposite one another. The longitudinal edges of the sheet material run freely between roller elements.

Therefore, there is a need for a device for conveying sheet-shaped material that works disturbance-free with high dependability.

SUMMARY OF THE INVENTION

The above need is satisfied by the present invention, wherein the guide plate engages into the channel-shaped recess. The individual sheets are thus reliably supplied to the generated surface of the roller or, respectively, of the counter-pressure roller. A tilting of the leading edges of the single sheet or of the lateral edges is largely precluded.

In one exemplary embodiment of the invention, at least one longitudinal edge runs in the channel-shaped recess. The corners of longitudinal edges of a sheet-shaped material, namely, can present problems during conveying since they can easily yield and be bent over when striking against counter-surfaces. The embodiment then provides that such longitudinal edges remain reserved from the pressure of the roller and of the counter-roller, i.e. run loosely along during conveying. Accordingly, no force that can effect a bending of the corners or of the edges can attack at such longitudinal edges. Consequently, the conveying of sheet-shaped material becomes more dependable then hitherto and ensues malfunction-free. Even if a plurality of conveyor devices of the invention are utilized in a single printer, the probability of outage due to conveying malfunctions is hardly increased since a faulty folding at the longitudinal edges cannot occur.

The shape of the recess provided in the invention can be rectangular, quadratic, semi-circular. The recess proceeds along the circumference of the respective roller. The recess or, respectively, the recesses can only be arranged on one roller, for example on the driven roller or on the counter-pressure roller. However, it is also possible to provide recesses on both rollers, whereby one preferably avoids having two recesses residing directly opposite one another.

The appertaining roller preferably has recesses at the locations at which longitudinal edges of single sheets of different width and formats proceed. What is thereby achieved is that it is also assured given a change in format that the longitudinal edges of the respective single sheets proceed within recesses and are conveyed merely force-free.

According to one embodiment of the invention, a paper running channel is formed by guide plates at at least one side of the conveying nip, these guide plates opening tunnel-shape in the direction of the conveying nip. The guide plates have salient sections that at least partially engage into the recess or, respectively, the recesses.

Given this type of arrangement of the guide plates, it is assured that a sheet of the sheet-shaped material is reliably supplied to the conveying nip between the roller and the counter-pressure roller or, respectively, is discharged therefrom without the leading edge or, respectively, the trailing edge of the sheet-shaped material being greatly bent down.

In an embodiment, the present invention provides a device for conveying sheets of material. The device comprises a cylindrical driven roller disposed opposite a cylindrical free wheeling counter-pressure roller. The driven roller and the counter-pressure roller are capable of engaging one another to form a conveying nip disposed therebetween. The counter-pressure roller comprises at least one circumferential channel-shaped recess. The driven roller comprises at least one circumferential channel-shaped recess. The at least one recess of the counter-pressure roller is aligned with the at least one recess of the driven roller. The device further comprises first and second parallel and opposing guide plates disposed on opposing sides of the nip. The guide plates define a channel for delivering the sheets of material to the nip. The first guide plate extends into the recess of the counter-pressure roller and the second guide plate extends into the recess of the driven roller. The first guide plate is pivotally mounted to the device and capable of being pivoted away from the driven roller.

In an embodiment, the guide plates are flared outward away from each other at the nip to thereby define a wider channel at the nip.

In an embodiment, the driven roller comprises two recesses disposed on opposing sides of a wider driving section that engages the counter-pressure roller. The second guide plate comprises a window-like aperture for at least partially accommodating the driving section of the driven roller. The second guide plate further comprises webs that extend through the two recesses of the driven roller and on opposing sides of the driving section thereof.

In an embodiment, the driven roller has a longitudinal axis and the second guide plate comprises a flared guide element disposed parallel to the longitudinal axis of the driven roller and at one side of the aperture. The flared guide element extending away from the counter-pressure roller.

In an embodiment, the first guide plate is pivotally mounted to the device for pivotal movement away from the counter-pressure roller.

In an embodiment, the counter-pressure roller comprises two recesses disposed on opposing sides of a wider engagement section that engages the driven roller. The first guide plate comprises a window-like aperture for at least partially accommodating the engagement section of the driven roller. The first guide plate further comprises webs that extend through the two recesses of the counter-pressure roller and on opposing sides of the engagement section thereof.

In an embodiment, the counter-pressure roller has a longitudinal axis and the first guide plate comprises a flared guide element disposed parallel to the longitudinal axis of the counter-pressure roller and on one side of the aperture. The flared guide element extends away from the driven roller.

Other objects and advantages of the present invention will become apparent from reading the following detailed description and appended claims, and upon reference to the accompanying drawings.

BRIEF DESCRIPTION OF THE DRAWINGS

An exemplary embodiment of the invention is explained below with reference to the drawing wherein.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
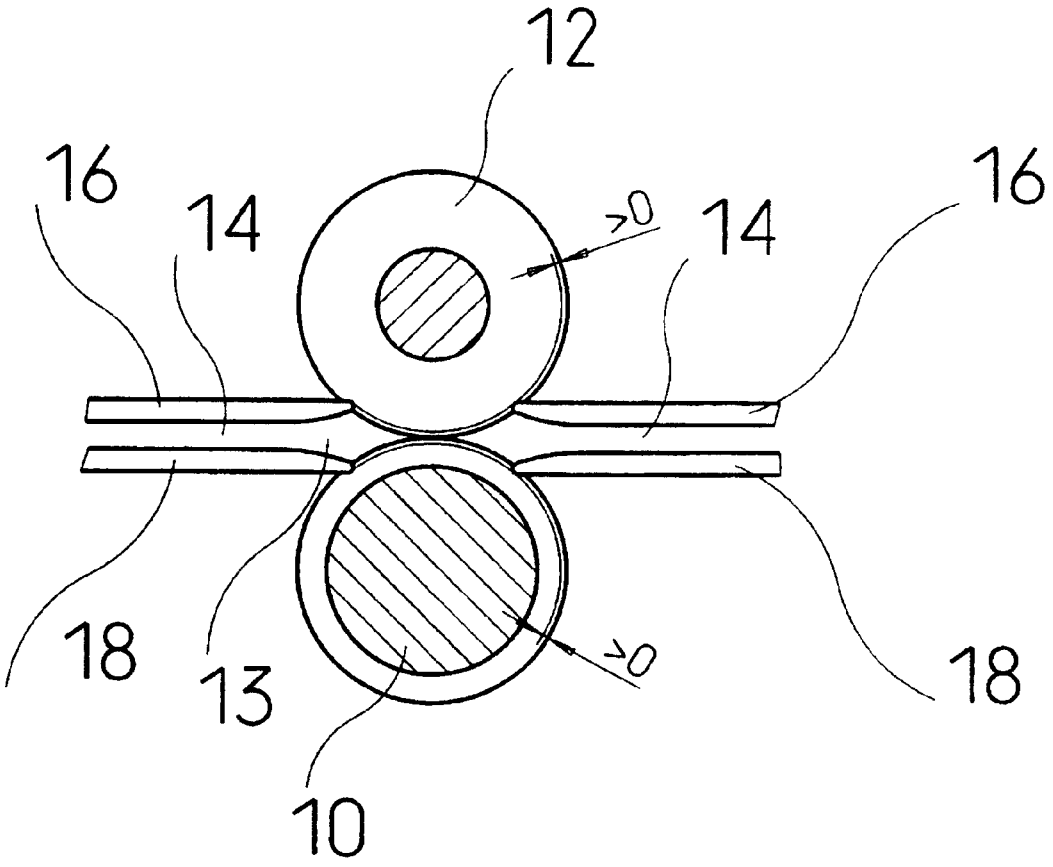
FIG. 1 is a partial schematic view of a conveyor device made in accordance with the present invention.

FIG. 1 shows a conveyor device of the invention. A plurality of such conveyor devices are utilized, for example, in a high-performance printer for printing single sheets. A driven, essentially cylindrical roller 10 as well as a free-running, likewise essentially cylindrical counter-pressure roller 12 lying opposite it form a conveying roller pair in whose conveying nip 13 single sheets of paper can be successively conveyed in both directions. Paper running channels 14 are formed by upper guide plates 16 and lower guide plates 18 at both sides of the conveying nip 13. As indicated in FIG. 1, the ends of the guide plates 16, 18 engage into recesses in the rollers 10, 12, as can be seen in greater detail in FIG. 2.

Figure 2:
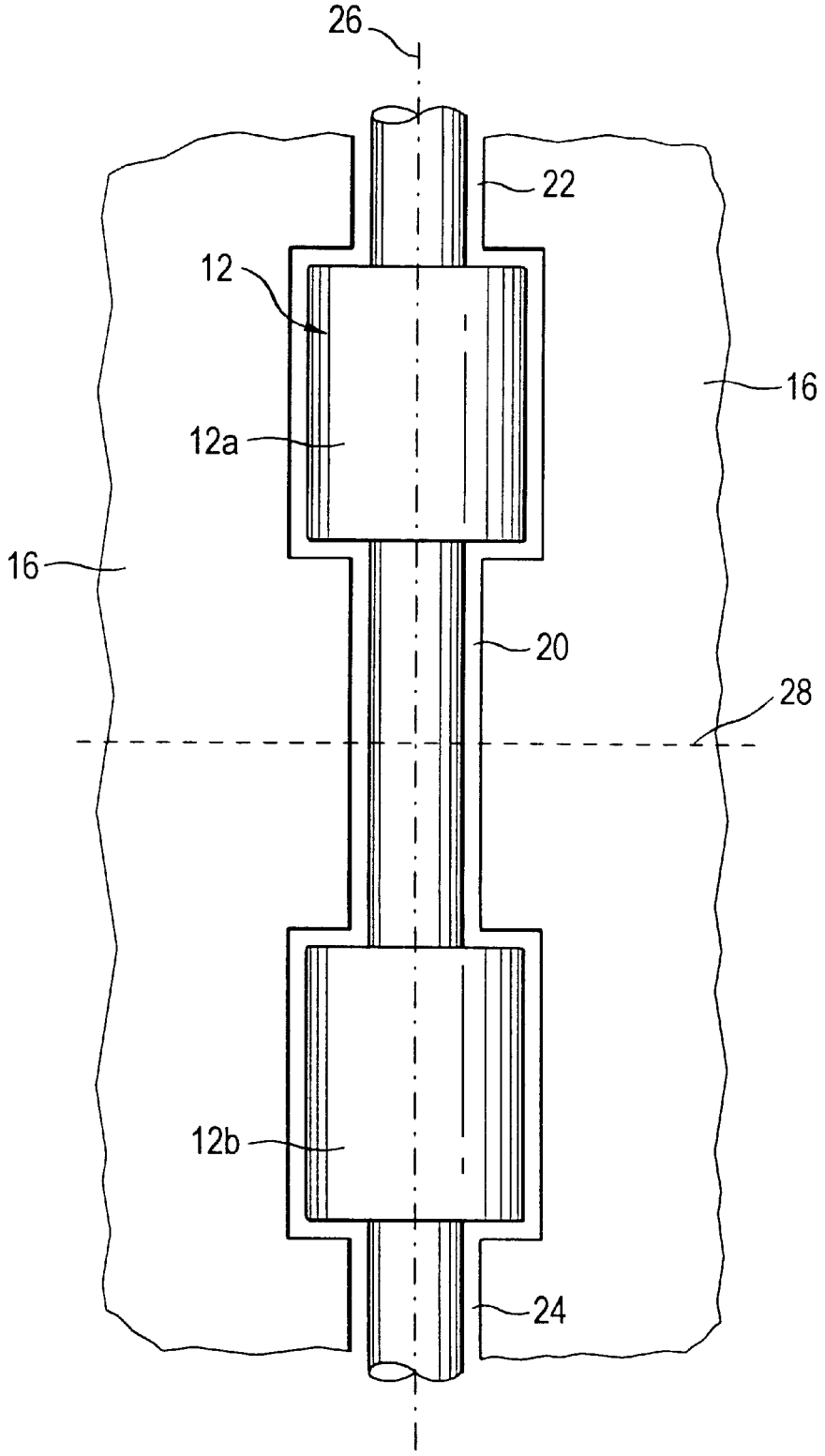
FIG. 2 is a partial schematic plan view of the conveyor device shown in FIG. 1.

FIG. 2 shows a part of a view onto the counter-pressure roller 12 seen from below. The counter-pressure roller 12 has recesses 20, 22, 24 disposed on opposing sides of engagement sections 12*a*, 12*b* and that proceed channel-shaped around the axis 26 of the counter-pressure roller 12. The recesses 20, 22, 24 have a rectangular cross-section in the present case. The upper guide plates 16 have projecting sections engaging into the recesses 20, 22, 24. Given a transport of single sheets, thus, the leading edge or, respectively, the trailing edge of a single sheet is guided such that nearly no sag ensues. In this way, the circumferential surfaces of the counter roller 12 sees the leading edge or, respectively, the trailing edge of the single sheet simultaneously and gently, so that a buckling of the leading edge or, respectively, of the trailing edge is not possible.

A longitudinal edge 28 of a single sheet is shown as a dashed line in FIG. 2. The longitudinal edge 28 proceeds approximately centrally within the recesses 20. When conveying the single sheet, no pressure bears on this longitudinal edge 28 within the recess 20. It can therefore also not be bent over—a paper jam or a creasing of the page is avoided.

It is to be pointed out that the generated surface of the counter-pressure roller or, respectively, of the roller preferably has a layer with high friction in order to convey the individual sheets with optimally little slippage.

Figure 3:
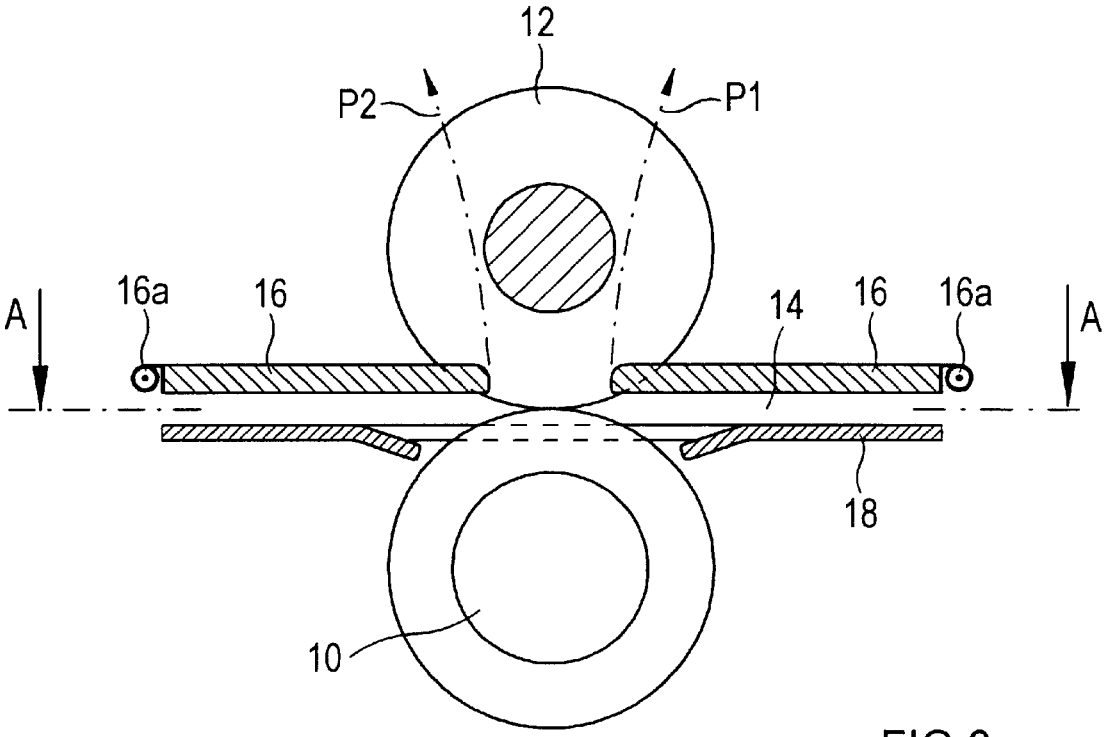
FIG. 3 is a second embodiment of a conveyor device made in accordance with the present invention, particularly illustrating a continuous, lower guide plate.
Figure 4:
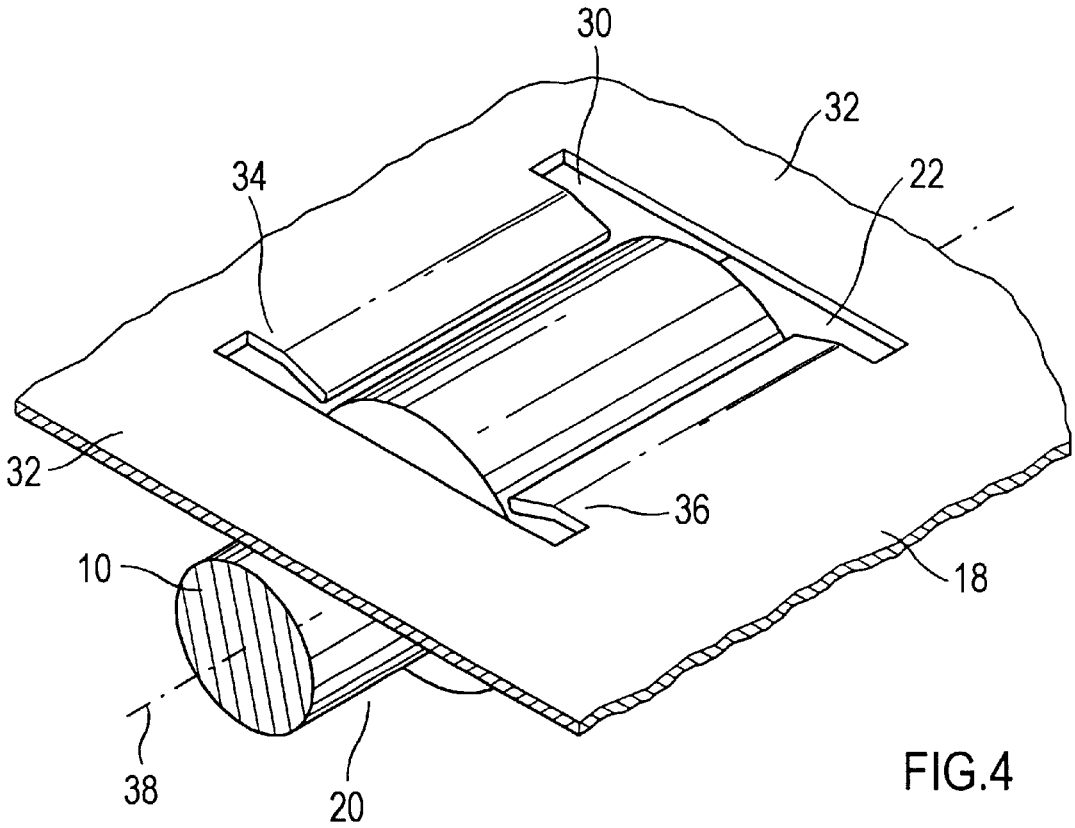
FIG. 4 is a perspective sectional view of the conveying device shown in FIG. 3 and taken substantially along line A—A of FIG. 3.

FIG. 3 shows a further exemplary embodiment of the invention wherein the paper running channel 14 is formed by two upper guide plates 16 arranged at both sides of the roller 10 and counter-pressure roller 12 as well as of a lower, continuous guide plate 18. The upper guide plates 16, which are pivotably mounted at 16*a* to the device, can be pivoted out in the direction of the arrows P1, P2 in order to be able to remove the single sheet or, respectively, sheets in case of a paper jam. The lower guide plate 18 has a window-like recess 30 with lateral webs 32. The aperture 30 accommodates the driving section 1 Oa of the roller 10. Recesses in the roller 10 are shown at 10*b*, 10*c*. The lateral webs 32 proceed within the channels 20, 22 of the pressure roller 10. The continuous guide plate 18 has two guide elements 34, 36 within the window-shaped recess 30 whose leading edges 34*a*, 36*a* are bent off in the direction of the longitudinal axis 38 of the roller 10. Given delivery of single sheets, the leading edge runs onto the bent-over section of the respective guide elements 34, 36 and is thus conveyed further along the guide plate 18—a threading of the leading edge of the single sheet into the gap between the guide elements 34, 36 and the roller 10 is thus avoided. Due to the symmetrical arrangement of the guide elements 34, 36, a reliable conveying in both conveying directions is assured.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A device for conveying sheets of material, the device comprising:

a cylindrical driven roller disposed opposite a cylindrical free wheeling counter-pressure roller, the driven roller and the counter-pressure roller are capable of engaging one another to form a conveying nip disposed therebetween, the counter-pressure roller comprising at least one circumferential channel-shaped recess, the driven roller comprising at least one circumferential channel-shaped recess, the at least one recess of the counter-pressure roller being aligned with the at least one recess of the driven roller, the device further comprising first and second parallel and opposing guide plates disposed on opposing sides of the nip, the guide plates defining a channel for delivering the sheets of material to the nip, the first guide plate extending into the recess of the counter-pressure roller, the second guide plate extending into the recess of the driven roller, one of the first and second guide plates being pivotally mounted to the device and capable of being pivoted out of the at least one recess of the respective roller.

2. The device of claim 1 wherein the guide plates are flared outward away from each other at the nip to thereby define a wider channel at the nip.

3. The device of claim 1 wherein the driven roller comprises two recesses disposed on opposing sides of a wider driving section that engages the counter-pressure roller, the second guide plate comprising a window-like aperture for at least partially accommodating the driving section of the driven roller, the second guide plate further comprising webs that extend through the two recesses of the driven roller and on opposing sides of the driving section thereof.

4. The device of claim 3 wherein the driven roller has a longitudinal axis and the second guide plate comprises a flared guide element disposed parallel to the longitudinal axis the driven roller and at one side of the aperture, the flared guide element extending away from the counter-pressure roller.

5. The device of claim 3 wherein the first guide plate is pivotally mounted to the device for pivotal movement away from the counter-pressure roller.

6. The device of claim 1 wherein the counter-pressure roller comprises two recesses disposed on opposing sides of a wider engagement section that engages the driven roller, the first guide plate comprising a window-like aperture for at least partially accommodating the engagement section of the counter pressure roller, the first guide plate further comprising webs that extend through the two recesses of the counter-pressure roller and on opposing sides of the engagement section thereof.

7. The device of claim 6 wherein the counter-pressure roller has a longitudinal axis and the first guide plate comprises a flared guide element disposed parallel to the longitudinal axis the counter-pressure roller and at one side of the aperture, the flared guide element extending away from the driven roller.

8. The device of claim 1 wherein the driven roller comprises a plurality of wider driving sections that engage the counter-pressure roller, each wider driving section being disposed between two recesses, the second guide plate comprising a plurality of window-like apertures, each aperture for at least partially accommodating one of the driving sections of the driven roller, the second guide plate further comprising a plurality of webs, each web extending through one of the recesses of the driven roller.

9. The device of claim 1 wherein the counter-pressure roller comprises a plurality of wider engagement sections that engage the driven roller, each wider engagement section being disposed between two recesses, the first guide plate comprising a plurality of window-like apertures, each aperture for at least partially accommodating one of the engagement sections of the counter-pressure roller, the first guide plate further comprising a plurality of webs, each web extending through one of the recesses of the counter-pressure roller.

* * * * *